US006892558B2

(12) United States Patent
Chodosh

(10) Patent No.: US 6,892,558 B2
(45) Date of Patent: May 17, 2005

(54) KEY HOLDER WITH AUTOMATIC EJECTION

(76) Inventor: David Jeffrey Chodosh, 1816 Fifth St., Manhattan Beach, CA (US) 90266

( * ) Notice: Subject to any disclaimer, the term of this patent is extended or adjusted under 35 U.S.C. 154(b) by 0 days.

(21) Appl. No.: 10/400,109

(22) Filed: Mar. 25, 2003

(65) Prior Publication Data

US 2003/0177798 A1 Sep. 25, 2003

Related U.S. Application Data

(60) Provisional application No. 60/367,177, filed on Mar. 25, 2002.

(51) Int. Cl.[7] ..... A47G 29/10

(52) U.S. Cl. ..... 70/456 R; 70/459; 206/37.2; 362/116

(58) Field of Search ..... 70/456 R, 459, 70/395, 408, 414, 454; 206/37.2, 37.3; 362/116

(56) References Cited

U.S. PATENT DOCUMENTS

| | | | | | |
|---|---|---|---|---|---|
| 1,642,791 | A | * | 9/1927 | Skorepa | |
| 1,885,957 | A | * | 11/1932 | Singleton | |
| 1,998,799 | A | * | 4/1935 | Woina et al. | |
| 2,517,500 | A | * | 8/1950 | McPherson et al. | |
| 2,738,668 | A | * | 3/1956 | Rock | 70/456 R |
| 2,795,128 | A | * | 6/1957 | Ly | |
| 2,822,684 | A | | 2/1958 | Ray | |
| 3,004,422 | A | * | 10/1961 | Starrett | |
| 3,599,458 | A | * | 8/1971 | Chow et al. | 70/459 |
| 3,696,649 | A | * | 10/1972 | Chow et al. | 70/456 R |
| 4,569,215 | A | * | 2/1986 | McCarthy et al. | 70/456 R |
| 4,660,397 | A | * | 4/1987 | Girimont | 70/456 R |
| 4,888,970 | A | * | 12/1989 | Kinzler et al. | 70/456 R |
| 5,435,160 | A | * | 7/1995 | Linsalato et al. | 70/408 |
| 5,487,291 | A | | 1/1996 | Voigt | 70/456 R |
| 5,495,942 | A | * | 3/1996 | Izhak | 206/372 |
| 5,621,936 | A | | 4/1997 | Penaligon et al. | 7/151 |
| 5,943,889 | A | * | 8/1999 | Chiu | 70/456 R |
| 6,106,131 | A | * | 8/2000 | Hao | 362/116 |
| 6,132,058 | A | * | 10/2000 | Kuo | 362/116 |
| 6,332,345 | B1 | | 12/2001 | Huang | 70/456 R |
| 6,460,386 | B1 | * | 10/2002 | Watanuki et al. | 70/456 R |
| 6,460,698 | B1 | * | 10/2002 | Wang | 206/234 |
| 6,705,141 | B1 | * | 3/2004 | Jacob et al. | 70/408 |

FOREIGN PATENT DOCUMENTS

| | | | | |
|---|---|---|---|---|
| DE | 3902537 | * | 8/1990 | 70/456 R |
| GB | 2084004 | * | 4/1982 | 70/456 R |

* cited by examiner

*Primary Examiner*—Lloyd A. Gall
(74) *Attorney, Agent, or Firm*—Christie, Parker & Hale, LLP

(57) ABSTRACT

A key holder is provided that includes an upper housing connected to a lower housing, such that the upper and lower housings together form a key housing. A turn table for receiving a key having an end portion is attached to the key housing. The turn table is movable between a first position and a second position, wherein in the first position the key end portion is retracted within the key housing and in the second position the key end portion extends from the key housing. The key housing includes a slot between the upper and lower housings for allowing movement of the key end portion when the turn table is moved between the first and second positions. A locking device is attached to the key housing and lockingly engages the turn table when the turn table is in the first position. A push button is moveable to cause the locking device to disengage the turn table, allowing the turn table to rotate from the first position to the second position.

15 Claims, 9 Drawing Sheets

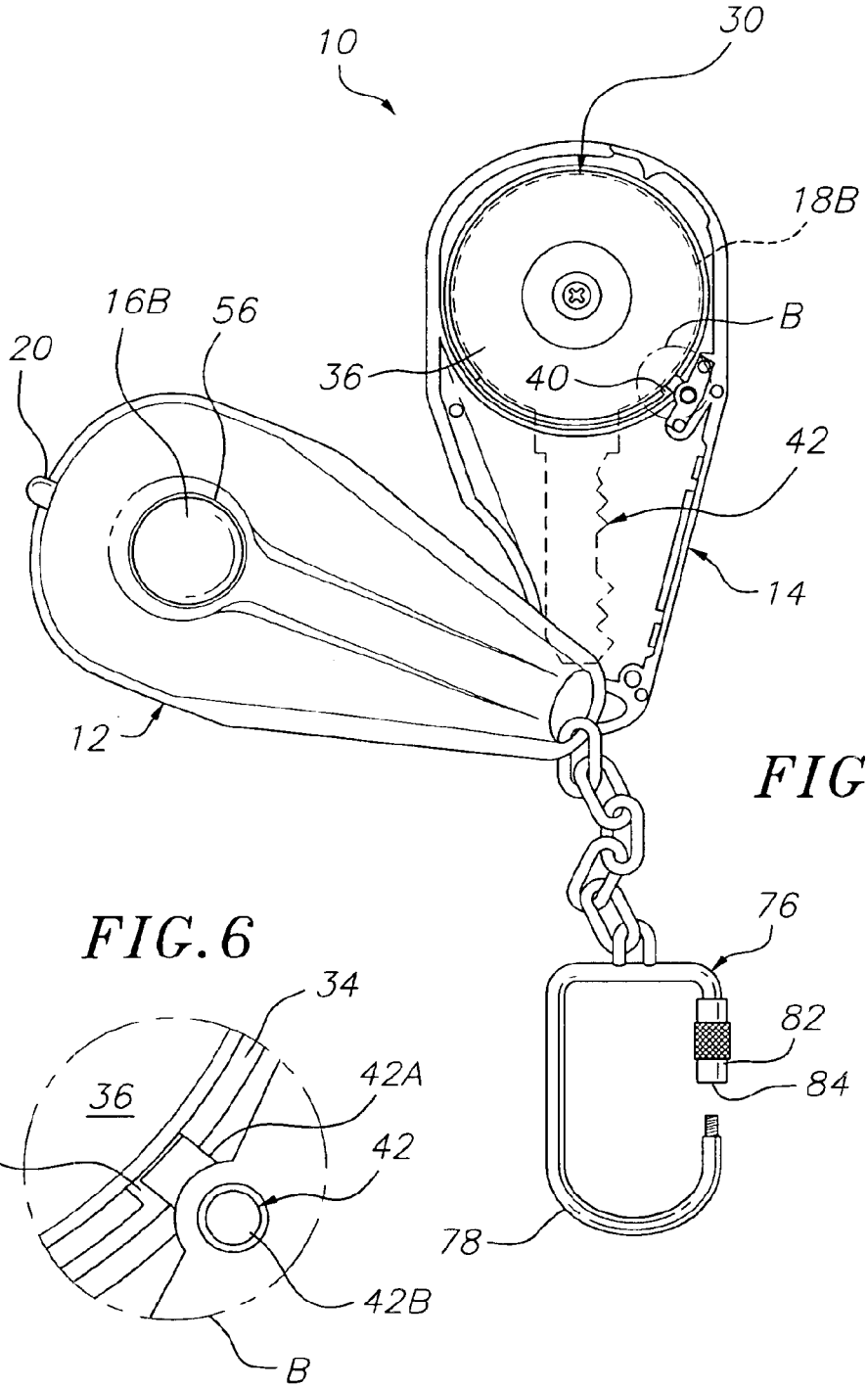
FIG. 5
FIG. 6
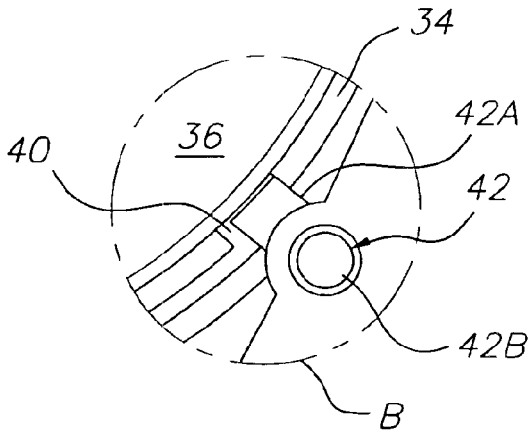

KEY HOLDER WITH AUTOMATIC EJECTION

CROSS-REFERENCE TO RELATED APPLICATION(S)

This application claims priority under 35 U.S.C. §119(e) to U.S. Provisional Application Ser. No. 60/367,177, filed on Mar. 25, 2002, the disclosure of which is incorporated by reference.

FIELD OF THE INVENTION

The present invention relates generally to a key holder and particularly to a key holder having a push button, wherein an actuation of the push button causes a key retained by the key holder to be moved from a retracted position to an extended position.

BACKGROUND

Key holders and key chains (hereinafter key holders) of varying types are commonly known. Key holders retain one of more keys (hereinafter key(s)), which typically have sharp teeth. A problem with key holders that do not protect the key(s) held thereon is that the teeth of the key(s) are exposed and can catch onto and tear or fray fabric or other soft materials, such as the fabric inside a pocket or another clothing item. In addition, the exposed teeth can be worn down over time when unnecessarily rubbed by rigid materials. Accordingly, a need exists for a key holder that covers the teeth of a key disposed thereon to protect nearby fabric or other soft materials and to protect the key teeth from unnecessary wear.

In addition to protection of the key, a low cost holder is desirable that allows easy mounting insertion of the key into the holder but allows a quick and easy release of the key. A low cost easy release key holder with provision for illumination is also desirable.

SUMMARY

In one embodiment, the present invention is a key holder including a housing having first and second opposing sides and a slot between the first and second sides. A turn table is mounted in the housing for receiving a body having an end, wherein the turn table is resiliently biased to rotate with such body between a first position with such body end retracted within the housing and a second position with such body end extended from the housing, and wherein the slot allows for movement of such body end through the slot when the turn table is rotated with such body between the first and second positions. A locking device locks the turn table with the body in the first position, wherein a pressure between the opposed sides of the housing causes the turn table with such body to be released from the locking of the locking device, allowing the turn table with such body to rotate due to the bias from the first position to the second position. In one embodiment, the body is a key.

In another embodiment, the present invention is a key holder having an upper housing connected to a lower housing, such that the upper and lower housings together form a key housing. A turn table for receiving a key having an end portion is attached to the key housing. The turn table is movable between a first position and a second position, wherein in the first position the key end portion is retracted within the key housing and in the second position the key end portion extends from the key housing. The key housing includes a slot between the upper and lower housings for allowing movement of the key end portion when the turn table is moved between the first and second positions. A locking device is attached to the key housing and lockingly engages the turn table when the turn table is in the first position. A push button is moveable to cause the locking device to disengage the turn table, allowing the turn table to rotate from the first position to the second position.

In another embodiment of the present invention, the key holder further includes a light source having an activated and a non-activated state. A battery is attached to the key housing and electrically connected to the light source, such that the movement of the push button that causes the locking device to disengage the turn table also causes a contact plate that is attached to the push button to electrically connect with the battery to activate the light source.

BRIEF DESCRIPTION OF THE DRAWINGS

These and other features and advantages of the present invention will be better understood by reference to the following detailed description when considered in conjunction with the accompanying drawings wherein:

FIG. 5 is a plan view of the key holder of FIG. 2, wherein a turn table is lockingly engaged with a locking device;

FIG. 6 is an enlarged view of detail B from FIG. 5;

DETAILED DESCRIPTION OF EMBODIMENTS OF THE INVENTION

Figure 1:
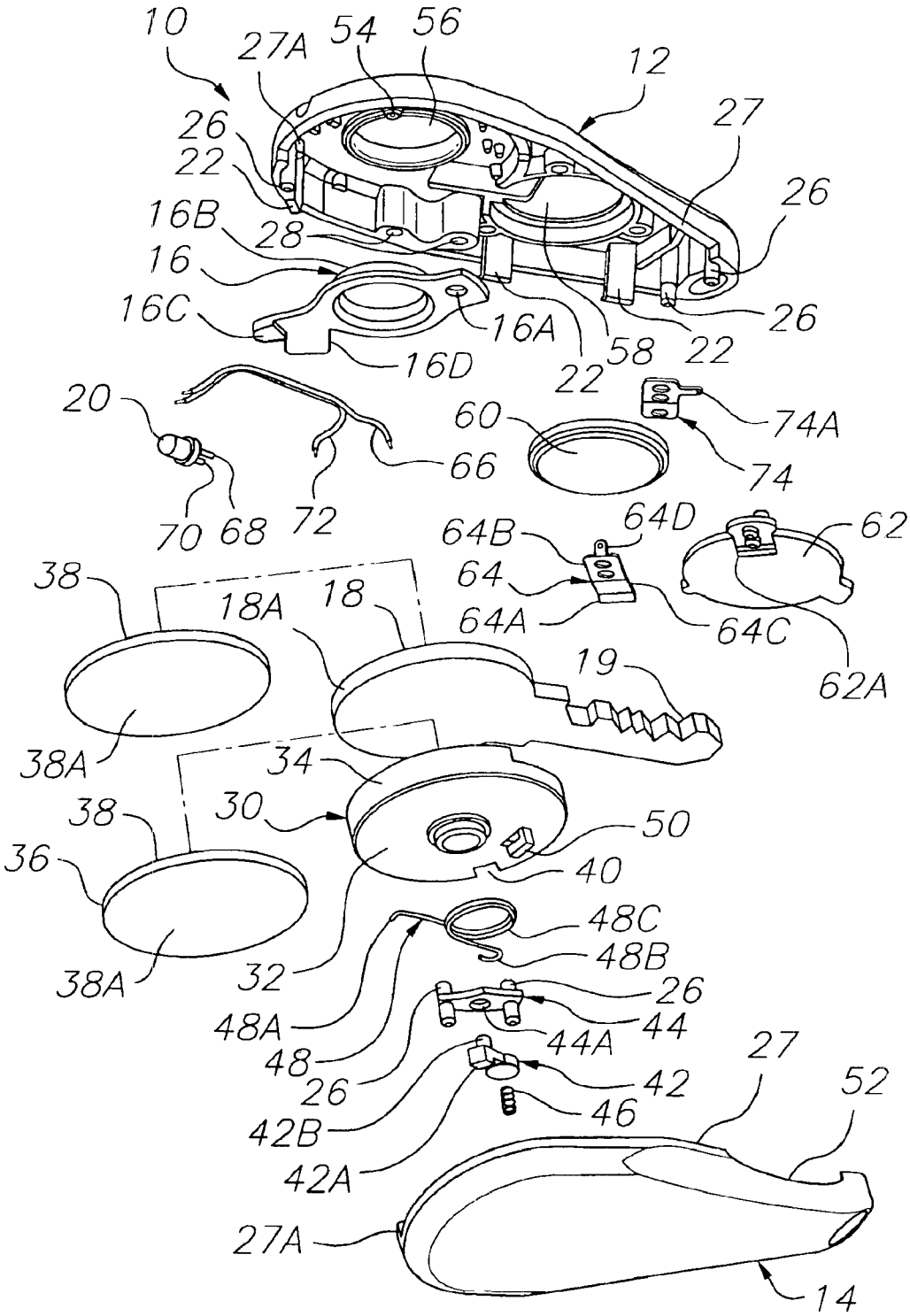
FIG. 1 is an exploded perspective view of a key holder according to one embodiment of the present invention.

As shown in FIGS. 1–10, embodiments of the present invention are directed to a key holder 10. The key holder 10 includes an upper housing 12 connected to a lower housing 14, such that the upper 12 and lower 14 housings together form a key housing 11. The key housing 11 includes a push button 16. Actuation of the push button 16 causes a key 18, inserted into and retained by the key holder 10 as described below, to be moved from a retracted position to an extended position. The terms "upper" and "lower" as used herein are relative terms and do not necessarily denote the actual position of the element. For example, an "upper" member may be located lower than a "lower" member.

FIG. 1 shows one embodiment of the key holder 10 according to the present invention. The key holder 10 includes the upper housing 12 and the lower housing 14, which together form the key housing 11. The upper 12 and lower 14 housings are removably connected, such as by a snap or press fit connection. However, a screw fastening connection, a clamping connection, or another appropriate removable connection may also be used.

For example, in the embodiment of FIG. 1 the upper housing 12 includes a plurality of tabs 22, which snap or press fit into slots 24A of the lower housing 14, which have protruding ramps 24 (see FIG. 2) that form interlocking connections with the tabs 22. The upper 12 and lower 14 housings also each include pins 26 that mate with openings 28 in the lower 14 and upper 12 housings, respectively. The mating pins 26 and openings 28 add stability to the key housing 11 when the upper housing 12 and the lower housing 14 are connected. In an alternative embodiment, the upper and lower housings are integrally formed, such that the key housing is formed as a single unitary structure. In such an embodiment, the upper and lower housings may have an integral hinge that allows the key housing to be moved between an open and a closed position. In such an embodiment, a key chain 76 (as shown in FIGS. 1A and 1B) may be attached to either the upper housing 12 or the lower housing 14 rather than being attached to both the upper housing 12 and the lower housing 14 as shown in FIGS. 1A and 1B.

Figure 1A:
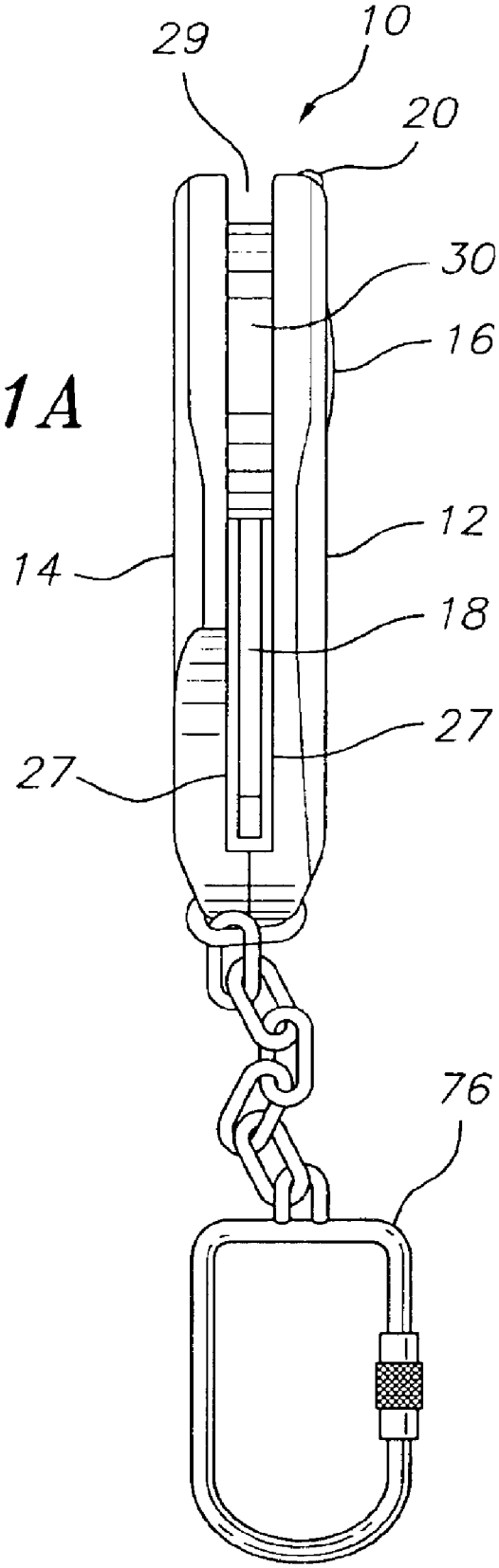
FIG. 1A is an assembled side view of the key holder of FIG. 1 showing a key retained by the key holder in a retracted position.
Figure 1B:
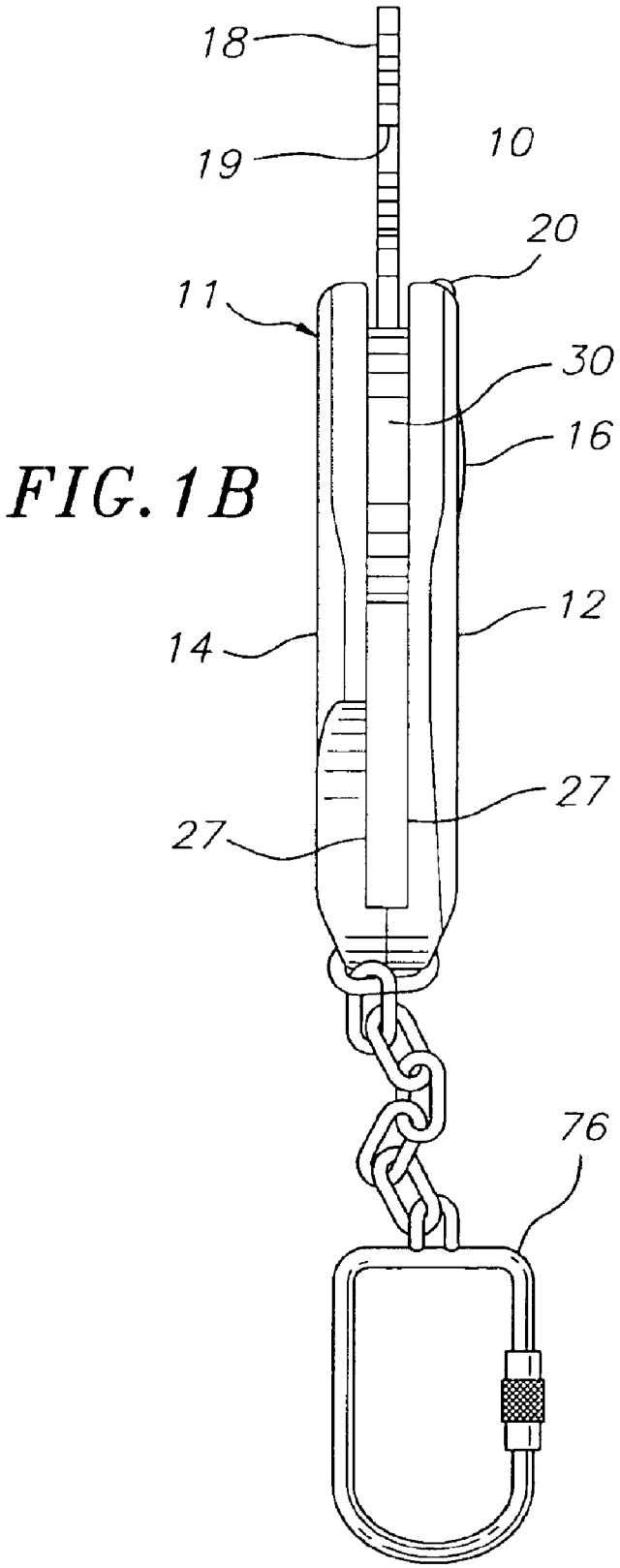
FIG. 1B is an assembled side view of the key holder of FIG. 1 showing a key retained by the key holder in an extended position.

The upper 12 and lower 14 housings also each have a longitudinal cutout 27, which together form a slot 29 in the key housing 11 when the upper 12 and lower 14 housings are connected(see FIGS. 1A and 1B). The slot 29 allows for a movement of the key 18 between the retracted and the extended positions. In one embodiment, the upper 12 and lower 14 housings are each composed of a molded flexible resilient plastic material with shape memory that allows separation at slot 29 for insertion of the key 18, but that returns to an original position as shown in FIGS. 1A and 1B to hold the key 18 mounted inside the key holder 10. The plastic housings 12 and 14 are easily molded and assembled to form a low cost key holder 10. In another embodiment, the upper 12 and lower 14 housings are each formed from a metal material, such as by machining or casting a metal part.

As shown in FIGS. 1–6, the lower housing 14 also includes a turn table 30. The turn table 30 includes a base 32 having a sidewall 34 extending therefrom (see FIGS. 2 and 4). The base 32 and sidewall 34 receive the key 18, such as a typical car or house key, which includes a head portion 18A and an end portion 18B having teeth 19. Although in alternative embodiments the key end portion does not include teeth. The turn table 30 is attached to the lower housing 14, for example, by a screw fastener 31, such that the turn table 30 is allowed to rotate with respect to the lower housing 14 about a point 25.

Figure 4:
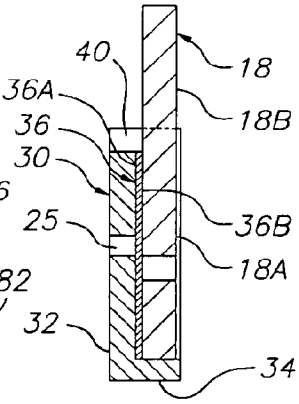
FIG. 4 is a longitudinal cross-section taken from line 4—4 of FIG. 2 along with a longitudinal cross-section of the key retained by the key holder.
Figure 7:
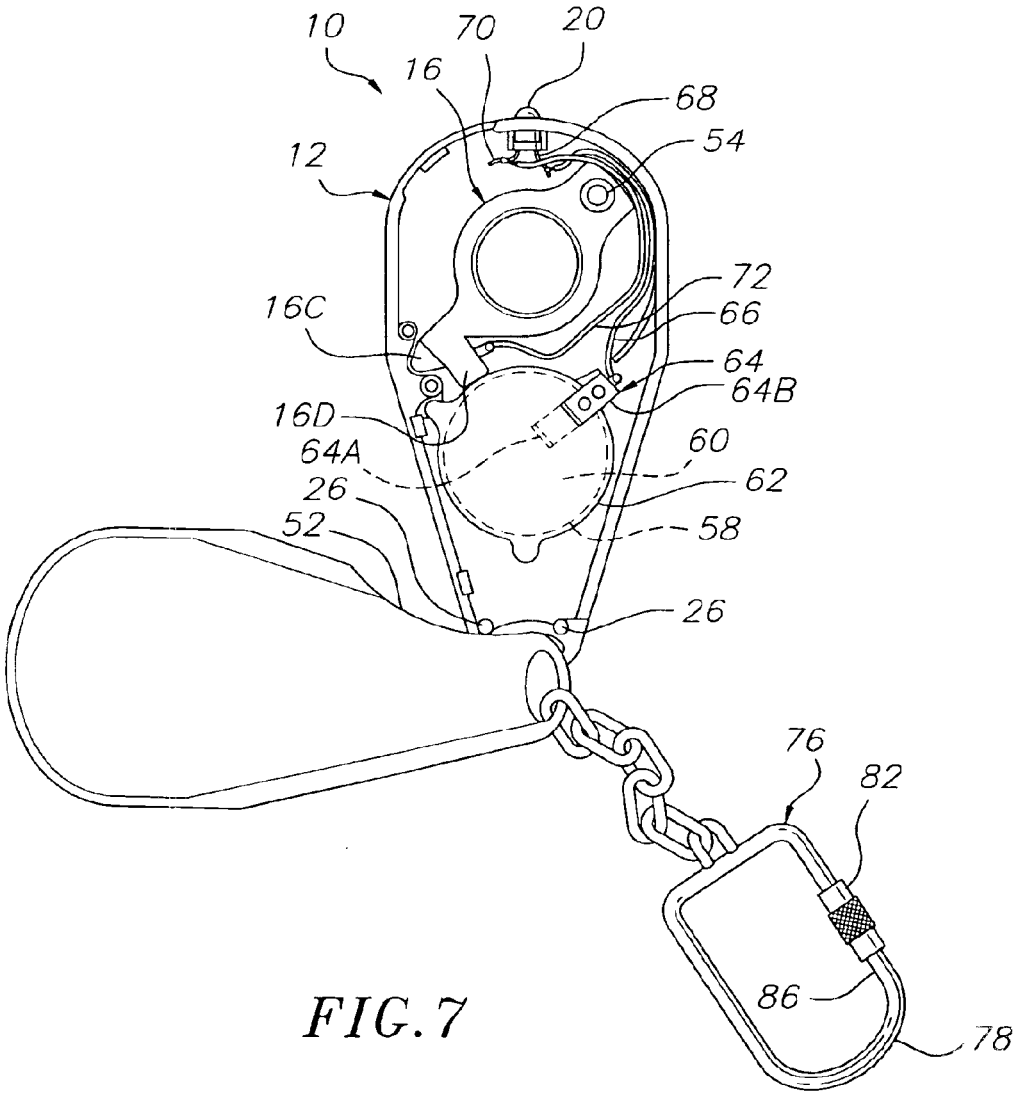
FIG. 7 is a plan view of the key holder of FIG. 1 assembled and disposed in an open position to show an inside view of a top housing of the key holder.

In the embodiment of FIGS. 1–7, the turn table 30 is substantially circular, and the sidewall 34 extends approximately 270 degrees around the perimeter of the turn table 30, leaving a slot or sidewall opening a of approximately 90 degrees. The sidewall opening a allows the end portion 18B of the key 18 to extend from the turn table 30 when the key 18 is received by the turn table 30, as shown in FIG. 4. Although a sidewall opening a of approximately 90 degrees is shown, any sidewall opening a that allows the end portion 18B of the key 18 to extend from the turn table 30 may be used. In addition, the turn table 30 may have shapes other than circular, such as rectangular or oval shapes among other appropriate shapes.

In one embodiment, the turn table 30 also includes on its surface a foam pad 36, such as a foam pad having a thickness of approximately 1/32 inches. The foam pad 36 includes an adhesive on a first surface 36A for securing the pad 36 to the base 32 of the turn table 30 and an adhesive on a second surface 36B for receiving and adhering to the head portion 18A of the key 18, thus securing the key 18 to turn table 30. As such, when the turn table 30 moves, such as by a rotation about the point 25, the key 18 correspondingly moves, and when the key 18 moves the turn table 30 correspondingly moves. In addition, since the adhesive of the second surface 36B of the pad 36 secures the key 18 to the turn table 30, it is not necessary that the sidewall 34 contact the head portion 18A of the key 18. Consequently, keys having a variety of different shaped head portions may be used with the key holder 10 of the present invention. In the embodiment depicted in FIG. 1, a second foam pad 38 having an adhesive on a first surface 38A only is applied to the head portion 18A of the key 18 to further secure the key 18 within the key housing 11.

Figure 2:
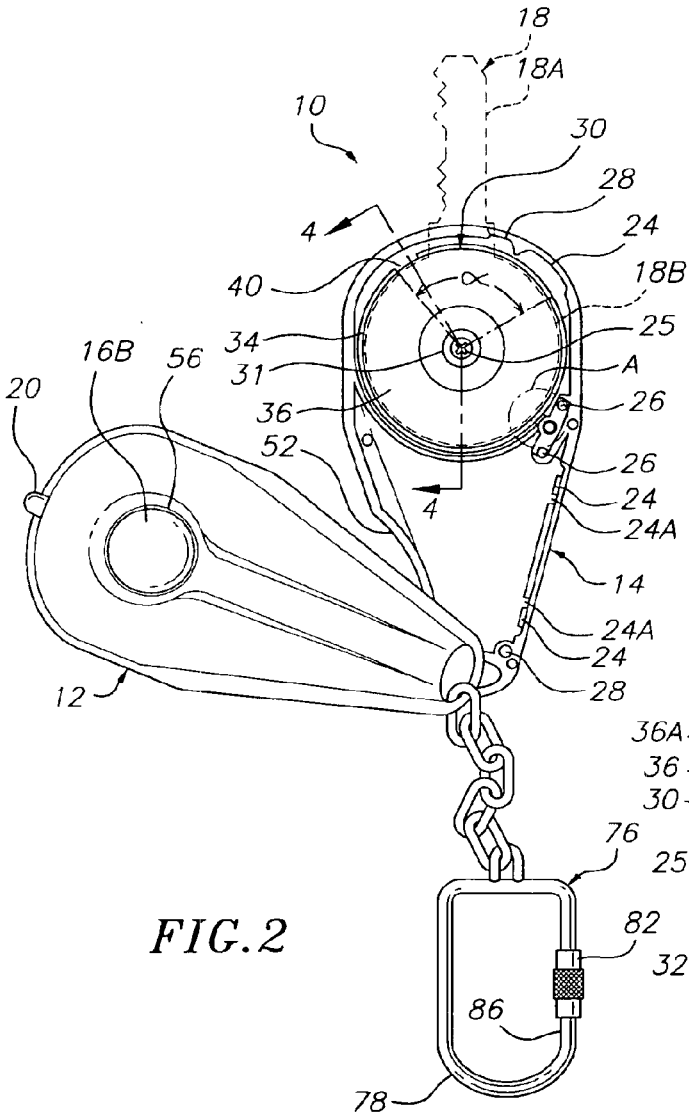
FIG. 2 is a plan view of the key holder of FIG. 1 assembled and disposed with a top housing removed to show an inside view of a bottom housing of the key holder.
Figure 3:
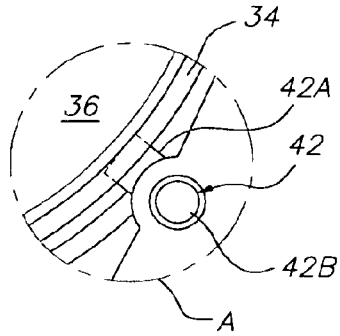
FIG. 3 is an enlarged view of detail A from FIG. 2.

The turn table 30 is moveable between a first position as shown in FIGS. 1A and 5 and a second position as shown in FIGS. 1B and 2 by rotating the turn table 30 about the point 25. In the first position, the head portion 18A and the end portion 18B of the key 18 are retracted within the key housing 11 (see FIG. 1A). As such, in the first position, the teeth 19 of the key 18 are protected against wear and are prevented from tearing nearby fabric and/or other soft materials. In the second position, the end portion 18B of the key 18 extends from the key housing 11 (see FIG. 1B) to enable the teeth 19 of the key 18 to be inserted into a key cylinder or lock. Typically when a user inserts a key 18 into a key cylinder or lock, the user does so by grasping the key head 18A. By contrast, when using the key holder 10 of the present invention, the user can insert the key 18 into a key cylinder or lock by grasping the key housing 11 which is much larger than a typical key head 18A. As such, a key that is assembled into the key holder 10 of the present invention is easier to manipulate than a typical key. Thus the key holder 10 is convenient for disabled persons or arthritis sufferers.

The turn table 30 also includes a turn table opening 40 that forms an interlocking connection with a locking device 42 when the turn table 30 is in the first position (see FIGS. 5 and 6). The locking device 42 includes a locking arm 42A and a releasing arm 42B. In one embodiment, the locking arm 42A and the releasing arm 42B are integrally formed (as shown in FIG. 1), such that a movement of the releasing arm 42B causes a corresponding movement of the locking arm 42A. In one embodiment the locking device 42 is mounted to the lower housing 14 via a locking holder 44. The locking holder 44 is mounted to the lower housing 14 by any one of a variety of means such as by an adhesive or an epoxy.

The locking device 42 is disposed adjacent to the locking holder 44, such as between the lower housing 14 and the locking holder 44, such that the releasing arm 42B extends from an opening 44A in the locking holder 44. A compression element 46, such as a compression spring, is disposed between the locking device 42 and the lower housing 14 to bias the releasing arm 42B towards the upper housing 12 and to bias the locking arm 42A towards the turn table 30. As such, when the turn table opening 40 is disposed above the locking arm 42A, the compression element 46 causes the locking arm 42A to automatically engage the turn table opening 40 to form an interlocking connection.

This interlocking connection can be disengaged by applying a force to the releasing arm 42B that overcomes the force that the compression element 46 applies to the locking device 42. The application of such a force causes the releasing arm 42B and hence the locking arm 42A to be depressed, thus moving the locking arm 42A out of engagement of the turn table opening 40. In an alterative embodiment, the locking device includes a locking arm that is integrally formed with the lower housing 14 and is formed of a flexible resilient plastic material with shape memory, such that when a force applied to the locking arm disengages the locking arm from the turn table opening 40, the resiliency of the locking arm material causes the locking arm to re-engage with the turn table opening 40 when the turn table opening 40 is disposed above the locking arm and the force is released. In this embodiment, the compression element 46 is not required.

In one embodiment, the turn table 30 is biased towards a second position (shown in FIG. 2). When the turn table 30 is biased towards the second position and the locking arm 42A is engaged with the turn table opening 40 in a first position (shown in FIG. 5), disengaging the locking arm 42A from the turn table opening 40, such as by depressing the releasing arm 42B, causes an automatic movement of the turn table 30 from the first position to the second position. This automatic movement or automatic ejection causes the end portion 18B of the key 18 to be released from a position retracted within the key housing 11, and rotated out of the key housing 11, stopping when the key 18 contacts a key stop 27A (see FIG. 1), which is formed in each cutout 27 of the upper 12 and lower 14 housings.

For example, in the embodiment depicted in FIG. 1, the turn table 30 is attached to a spring 48, such as a torsional spring, that biases the turn table 30 towards the second position. The spring 48 may be attached to the turn table 30 by any one of a variety of ways. For example, in the embodiment depicted in FIG. 1, a protrusion 50 extends from an underside surface of the base 32 of the turn table 30, and the spring 48 includes a first arm 48A having a bent end that hooks onto the protrusion 50 to form an interlocking connection. A second arm 48B of the spring 48 is attached to the lower housing 14 by any one of a variety of ways, such as by an adhesive, an epoxy, or an interlocking connection.

When so attached, a rotation of the turn table 30 from the second position to the first position causes coils 48C in the spring 48 to be compressed to resist the rotation. As such, when the turn table 30 is in the second position (wherein the end portion 18B of the key 18 is extended from the key housing 11) and a user desires to rotate the turn table 30 to the first position (wherein the end portion 18B of the key 18 is retracted within the key housing 11), the user must apply a rotational force on the end portion 18B of the key 18 that overcomes the spring force in the spring 48 and rotate the end portion 18B of the key 18 (which causes a corresponding rotation of the turn table 30) until the turn table opening 40 engages the locking arm 42A of the locking device 42. In one embodiment, the lower housing 14 includes an ergonomically designed curve 52, or finger indention, that facilitates rotating the end portion 18B of the key 18 within the key housing 11.

The upper housing 12 includes a receptacle 58 for receiving a battery 60, such as a typical 1.5 or 3 volt button cell battery. A protective cover 62 is fixedly attached to the receptacle 58, such as by an epoxy, to secure the battery 60 within the receptacle 58. Alternatively, the cover 62 may be releasably connected to the receptacle 58, such as by a snap-fit connection. An electrically conductive first contact plate 64 includes a first portion 64A that maintains electrical contact with the battery 60 and a second portion 64B that extends through a slit 62A in the cover 62 and is mounted to the receptacle 58, such as by an epoxy or snap-fit connection. In one embodiment, the first contact plate 64 includes a preformed bend 64C that allows the first portion 64A of the first contact plate 64 to maintain electrical contact with the battery 60.

The first contact plate 64 also includes a tab 64D that is electrically connected to an electrically conducting first wire 66. The first wire 66, in turn, is electrically connected to a first terminal 68 of the light source 20, such as an LED. The light source 20 includes a second terminal 70 that is electrically connected to an electrically conducting second wire 72. The second wire 72, in turn is electrically connected to a tab 74A that extends from an electrically conductive second contact plate 74. The second contact plate 74 is mounted to the connecting arm 16D of the push button 16, such as by an epoxy. A movement by the connecting arm 16D of the push button 16, described in detail below, causes the second contact plate 74 to contact the battery 60, thus closing the circuit between the battery 60 and the light source 20, which activates the light source 20.

The first contact plate 64 and the second contact plate 74 may each electrically contact either the positive or the negative terminal of the battery 60, as long as one of the contact plates 64 or 74 electrically contacts the positive terminal of the battery 60 and the other contact plate 74 or 64 electrically contacts the negative terminal of the battery 60. In one embodiment, each of the electrical connections between: the first contact plate tab 64D and the first wire 66, the first wire 66 and the light source first terminal 68, the light source second terminal 70 and the second wire 72, and the second wire 72 and the second contact plate tab 74A are made by a solder connection.

In the embodiment of FIG. 1, the upper housing 12 includes the push button 16. The push button 16 may be attached to the upper housing 12 by any one of a variety of ways. For example, in the embodiment of FIG. 1, the push button 16 includes a push button opening 16A, a push button knob 16B, a push button release lever 16C, and a push button connecting arm 16D. In one embodiment, the push button 16 is attached to the upper housing 12 by placing the push button 16 over a pin 54 that extends from the upper housing 12, such that the pin 54 extends from the push button opening 16A. The pin 54 and push button 16 are then heat welded, such that a portion of the pin 54 is fused to a portion of the push button 16 in an area around the push button opening 16A.

When so attached, the push button knob 16B is accessible from an exterior of the key housing 11 through an opening 56 in the upper housing 12, the push button release lever 16C is disposed adjacent to the releasing arm 42B of the locking device 42 and the second contact plate 74, which is mounted to the connecting arm 16D, is disposed adjacent to but not in contact with the battery 60.

As such, when a user depresses the push button knob 16B, the push button 16 rotates about the pin 54, allowing the push button release lever 16C to contact and depress the releasing arm 42B of the locking device 42 and allowing the second contact plate 74 to electrically contact the battery 60. As previously discussed, depressing the releasing arm 42B of the locking device 42 when the locking arm 42A of the locking device 42 is engaged with the turn table opening 40 causes the locking arm 42A to disengage the turn table opening 40, which in turn causes an automatic movement of the turn table 30 from the first position to the second position. When the second contact plate 74 electrically contacts the battery 60, the light source 20 is activated. Therefore, when the user depresses the push button knob 16B, the movement of the push button 16 causes the turn table 30 to move from the first position to the second position, and also causes the light source 20 to activate. In addition, although depressing the push button knob 16B has no effect on the turn table 30 when the turn table 30 is not in the first position, depressing the push button knob 16B activates the light source 20 no matter what position the turn table 30 is in.

Figure 8A:
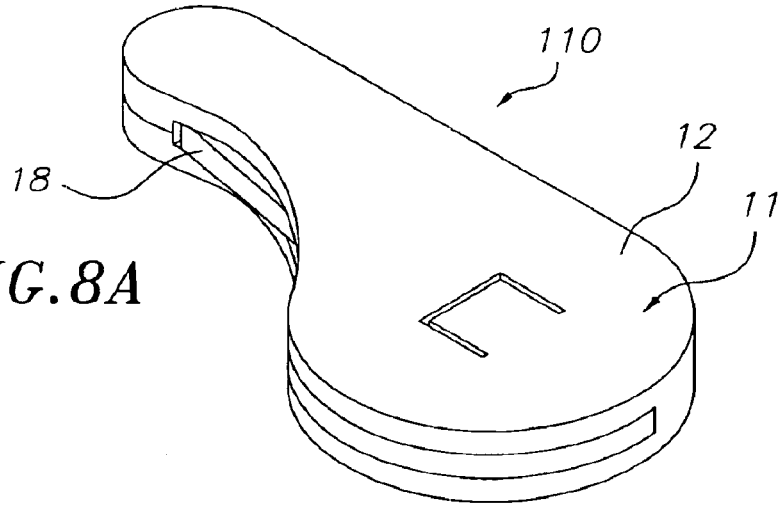
FIG. 8A is an assembled view of a key holder according to another embodiment of the present invention showing a key in a retracted position.
Figure 8B:
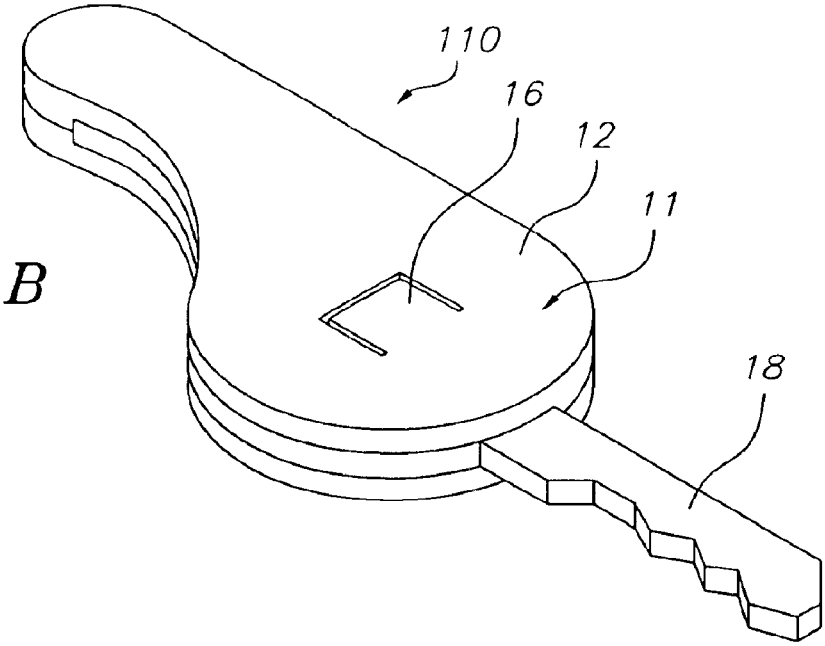
FIG. 8B is an assembled view of a key holder of FIG. 8A, showing the key in an extended position.
Figure 9:
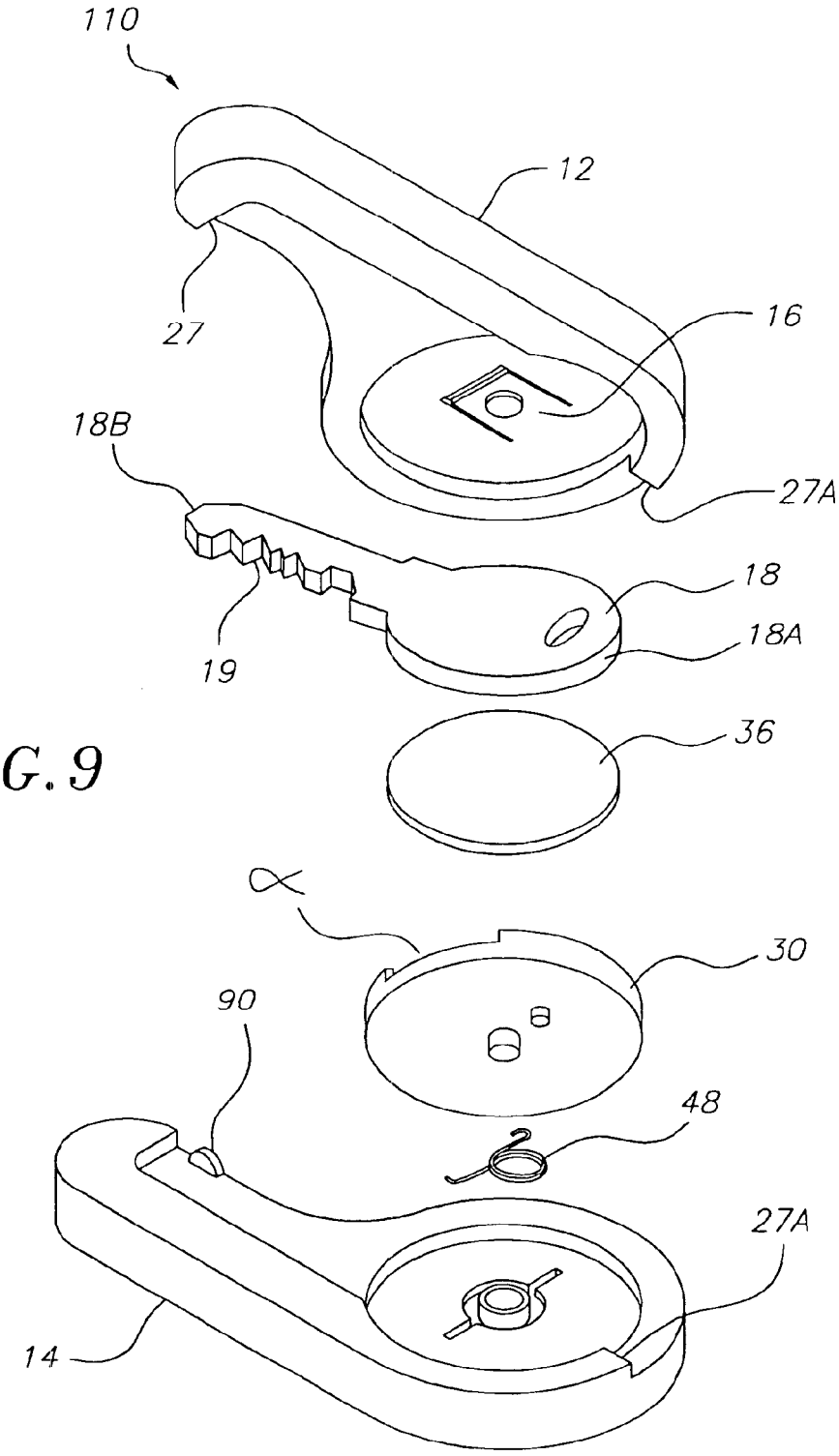
FIG. 9 is an exploded view of the key holder of FIG. 8A.
Figure 10:
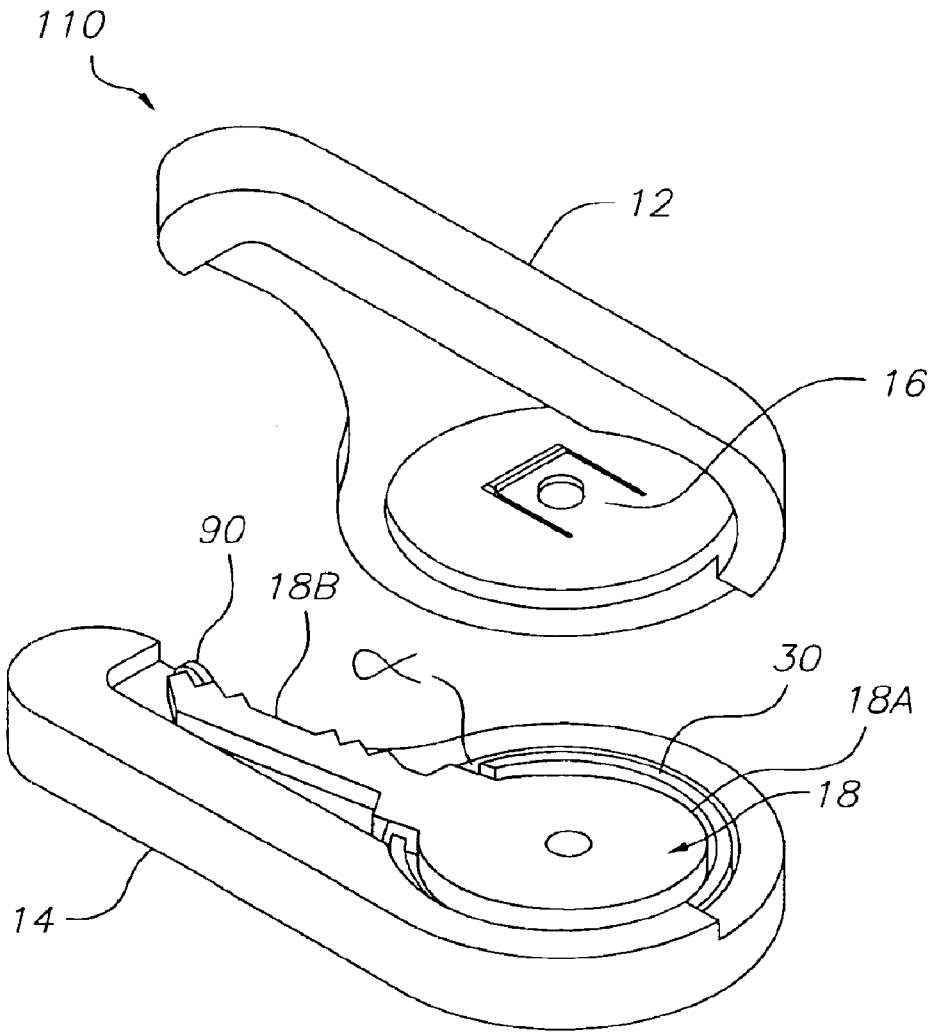
FIG. 10 is a partially assembled exploded view of the key holder of FIG. 8A.

In an alterative embodiment, as shown in FIG. 8A, the push button 16 is integrally formed with the upper housing 12 and is formed of a flexible resilient plastic material with shape memory, such that when an appropriate force is applied to push button 16, the push button 16 retracts into the key housing 11 and when the appropriate force is released, the resiliency of the push button material causes the push button 16 return to its original position.

In one embodiment, the key holder 10 also includes the key chain 76, such as a conventional ring-type key chain, that is attached to the key housing 11. An exemplary key chain 76 is shown in FIG. 2 in a closed position and in FIG. 5 in an open position. The key chain 76 includes a ring 78 having a collar 82 threadably connected thereto. As shown in FIG. 5, the ring 78 includes an externally threaded end 80 that threadably engages an internally threaded end 84 of the collar 82. When the collar 82 is not threadably engaged with the ring 78, one or more keys (not shown) may be attached to the key chain 76. The collar 82 may then be threadably connected to the ring 78 to form an enclosed perimeter 86 that retains the one or more keys. In other embodiments, the key chain 76 includes a spring loaded clip that allows entry of keys onto the key chain 76 when the spring is depressed, but holds the key within the key chain 76 when the spring is released. Alternatively, the key chain 76 may incorporate appropriate closure mechanisms, other than the above described spring clip and threaded collar.

FIGS. 8A–10 show a key holder 110 according to an alternative embodiment of the invention. In the embodiment of FIGS. 8A–10, the end portion 18B of the key 18 forms an interlocking connection with a locking element 90 that is integrally formed with the lower housing 14. In this embodiment, when the end portion 18B of the key 18 is interlocked with the locking element 90 and an appropriate force is applied to the push button 16, the head portion 18A of the key 18 depresses slightly and the end portion 18B of the key 18 raises slightly. This movement raises the end portion 18B of the key 18 out of engagement with the locking element 90 and allows the key 18 to rotate into the second position as described above.

Although the embodiment of FIGS. 8A–10 does not illustrate a light source, it will be obvious to those skilled in the art that a light source could be added to this embodiment similar to the light source 20 illustrated and described with reference to the embodiment of FIG. 1–7.

Although a key 18 has been illustrated and described above, other bodies may be incorporated into the key holder of the present invention. Exemplary bodies for incorporation into the key holder of the present invention include a key, a nail file, an emery board, tweezers, a pencil, a pen, a corkscrew, an LCD timepiece, an LCD watch, a safety whistle, a letter opener, or a bottlecap opener among other appropriate bodies.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A key holder comprising:

an upper housing;

a lower housing connected to the upper housing, wherein the upper and lower housings together form a key housing;

a turn table for receiving a key having an end portion, wherein the turn table is movable between a first position and a second position, wherein in the first position the key end portion is retracted within the key housing and in the second position the key end portion extends from the key housing, and wherein the key housing has a slot between the upper and lower housings for allowing movement of the key end portion when the turn table is moved between the first and second positions;

a locking device attached to the key housing, wherein the locking device lockingly engages the turn table when the turn table is in the first position;

a push button moveable to cause the locking device to disengage the turn table, allowing the turn table to rotate from the first position to the second position;

a light source attached to the key housing, wherein the light source has an activated and a non-activated state; and a battery attached to the key housing and electrically connected to the light source, wherein said movement of the push button that causes the locking device to disengage the turn table also causes a contact plate that is attached to the push button to electrically connect with the battery to activate the light source.

2. The key holder of claim 1, wherein the locking device comprises a locking arm and a releasing arm, and the turn table comprises an opening that lockingly engages the locking arm when the turn table is in the first position, and wherein a movement of the releasing arm causes the locking arm to disengage from the turn table opening.

3. The key holder of claim 2, wherein said movement of the push button causes the movement of the releasing arm that causes the locking arm to disengage from the turn table opening.

4. The key holder of claim 3, wherein the turn table is biased towards the second position, such that disengaging the locking arm from the turn table when the turn table is in the first position causes an automatic movement of the turn table from the first position to the second position.

5. The key holder of claim 1, wherein the key housing is comprised of a molded plastic material.

6. The key holder of claim 1, further comprising a key chain attached to the key housing for retaining one or more keys.

7. The key holder of claim 1, further comprising a pad having an adhesive on a first surface for securing the pad to the turn table and having an adhesive on a second surface for receiving the key and for securing the key to the key housing.

8. A key holder comprising:

an upper housing;

a lower housing connected to the upper housing, wherein the upper and lower housings together form a key housing;

a turn table for receiving a key having an end portion, wherein the turn table is rotatable between a first position and a second position, wherein in the first position the key end portion is retracted within the key housing and in the second position the key end portion extends from the key housing, and wherein the key housing has a slot between the upper and lower housings for allowing movement of the key end portion when the turn table is rotated between the first and second positions;

a locking device attached to the key housing, wherein the locking device lockingly engages the turn table when the turn table is in the first position;

a light source attached to the key housing, wherein the light source has an activated and a non-activated state; and a push button moveable to cause the locking device to disengage the turn table, causing the turn table to rotate from the first position to the second position, and wherein said movement of the push button also causes the light source to activate.

9. The key holder of claim 8, wherein the locking device comprises a locking arm and a releasing arm, and the turn table comprises an opening that lockingly engages the locking arm when the turn table is in the first position, and wherein a movement of the releasing arm causes the locking arm to disengage from the turn table opening.

10. The key holder of claim 9, wherein said movement of the push button causes the movement of the releasing arm that causes the locking arm to disengage from the turn table opening.

11. The key holder of claim 10, further comprising a torsional spring attached to the turn table to bias the turn table towards the second position, such that disengaging the locking arm from the turn table when the turn table is in the first position causes an automatic rotation of the turn table from the first position to the second position.

12. The key holder of claim 8, further comprising a battery attached to the key housing and electrically connected to the light source and further comprising a contact plate attached to the push button, wherein said movement of the push button causes the contact plate to electrically connect with the battery to activate the light source.

13. The key holder of claim 8, wherein the key housing is comprised of a molded plastic material.

14. The key holder of claim 8, further comprising a key chain attached to the key housing for retaining one or more keys.

15. The key holder of claim 8, further comprising a pad having an adhesive on a first surface for securing the pad to the turn table and having an adhesive on a second surface for receiving the key and for securing the key to the key housing.

* * * * *